US008155553B2

(12) United States Patent
Takarada

(10) Patent No.: US 8,155,553 B2
(45) Date of Patent: Apr. 10, 2012

(54) DEVELOPING APPARATUS, PROCESS CARTRIDGE, AND ELECTROPHOTOGRAPHIC IMAGE FORMING APPARATUS

(75) Inventor: Hiroshi Takarada, Gotemba (JP)

(73) Assignee: Canon Kabushiki Kaisha, Tokyo (JP)

( * ) Notice: Subject to any disclaimer, the term of this patent is extended or adjusted under 35 U.S.C. 154(b) by 490 days.

(21) Appl. No.: 12/468,577

(22) Filed: May 19, 2009

(65) Prior Publication Data

US 2009/0297202 A1 Dec. 3, 2009

(30) Foreign Application Priority Data

May 27, 2008 (JP) ..... 2008-138040
Apr. 27, 2009 (JP) ..... 2009-107877

(51) Int. Cl.
*G03G 15/00* (2006.01)

(52) U.S. Cl. ..... 399/90; 399/111; 399/119; 399/285

(58) Field of Classification Search ..... 399/90, 399/111, 119, 227, 285
See application file for complete search history.

(56) References Cited

U.S. PATENT DOCUMENTS 7,024,137 B2 4/2006 Nittani et al. ..... 399/222
7,215,909 B2 5/2007 Nittani et al. ..... 399/222

FOREIGN PATENT DOCUMENTS

JP 11-338211 12/1999
JP 2004-12523 1/2004

*Primary Examiner* — David Gray
*Assistant Examiner* — Barnabas Fekete
(74) *Attorney, Agent, or Firm* — Fitzpatrick, Cella, Harper & Scinto

(57) ABSTRACT

A developing apparatus includes a developing roller for developing an electrostatic latent image formed on a photosensitive member. A drive transmission member is provided at one end of the developing roller for receiving a driving force and transmitting the driving force to the developing roller. The developing apparatus also includes an urging member, provided at other end of the developing roller, for urging the developing roller. An abutting portion is abutted by the shaft of the developing roller by an urging force of the urging member to position the developing roller with respect to the axial direction of the developing roller, and a contact member contacts a peripheral surface of the shaft of the developing roller to apply a voltage to the developing roller.

10 Claims, 11 Drawing Sheets

DEVELOPING APPARATUS, PROCESS CARTRIDGE, AND ELECTROPHOTOGRAPHIC IMAGE FORMING APPARATUS

FIELD OF THE INVENTION AND RELATED ART

The present invention relates to a developing apparatus, a process cartridge, and an electrophotographic image forming apparatus which uses a process cartridge.

Here, an electrophotographic image forming apparatus means an apparatus which forms an image on recording medium with the use of an electrophotographic image forming method. Examples of an electrophotographic image forming apparatus include an electrophotographic copying machine, an electrophotographic printer (for example, laser beam printer, LED printer, etc.), a facsimile apparatus, a wordprocessor, etc.

A process cartridge means a cartridge in which an electrophotographic photosensitive drum and one or more processing apparatuses, that is, a charging means, a developing means, and a cleaning means, are integrally disposed, and which is removably mountable in the main assembly of an electrophotographic image forming apparatus. More specifically, a process cartridge means a cartridge in which an electrophotographic photosensitive drum, a charging means, and a developing means or cleaning means, are integrally disposed, and which is removably mountable in the main assembly of an image forming apparatus. It also means a cartridge in which an electrophotographic photosensitive drum, and at least one among a charging means, a developing means, and a cleaning means, are integrally disposed, and which is removably mountable in the main assembly of an image forming apparatus. Further, it also means a cartridge in which an electrophotographic photosensitive drum and a developing means are integrally disposed, and which is removably mountable in the main assembly of an image forming apparatus.

In the field of an electrophotographic image forming apparatus which uses an electrophotographic image formation process, it has been common practice to employ a process cartridge system, which integrally disposes an electrophotographic photosensitive drum and one or more means for processing the electrophotographic photosensitive drum in a cartridge so that they can be removably mountable in the main assembly of an image forming apparatus. A process cartridge system enables in effect a user to maintain an electrophotographic image forming apparatus by himself or herself, that is, without relying on a service person. Thus, it can drastically improve an electrophotographic image forming apparatus in operational efficiency. Therefore, a process cartridge system is widely in used in the field of an electrophotographic image forming apparatus.

An electrophotographic image forming apparatus forms an electrostatic latent image on its photosensitive drum by projecting a beam of light emitted by a laser, an LED, an ordinary lamp, or the like, while modulating the beam of light with the information regarding an image to be formed.

Then, it develops the electrostatic latent image on the photosensitive drum into a toner image. More specifically, it applies a development bias to the development roller with which its developing apparatus is provided. As a result, the electrostatic latent image on the photosensitive drum is developed into a toner image with the toner on the development roller. Then, it transfers the toner image on the photosensitive drum onto recording medium.

Thus, the development unit 4 is provided with electrical contacts for applying bias voltage to the development roller, etc. The electrical contacts are formed of electrically conductive plate or the like. Thus, it is common practice to structure an electrophotographic image forming apparatus so that as a developing apparatus or a process cartridge is mounted into the main assembly of the image forming apparatus, its electrical contacts come into contact with the counterparts of the main assembly of the image forming apparatus.

As one of the means for driving the development roller in a process cartridge, such as the one described above, the driving means disclosed in Japanese Laid-open Patent Application 2004-12523 has been well-known. In the case of this development roller driving means, one of the lengthwise ends of the shaft of the development roller, which is to be fitted with a driving force transmitting (receiving) member, for example, a helical gear, is given such a cross-sectional shape (for example, D-shaped or H-shaped) that prevents the driving force transmitting member from slipping relative to the shaft in terms of the rotational direction.

More specifically, in terms of the direction of the teeth of the helical gear, the helical gear is structured so that as driving force is applied (transmitted) to the helical gear from the main assembly of the image forming apparatus, thrust is generated in the direction to push the development roller in the lengthwise direction of the development roller. Further, the electrical contacts for supplying the development roller with the development bias are disposed so that they contact the opposite lengthwise end of the shaft of the development roller from the helical gear in terms of the lengthwise direction of the axial line of the development roller.

There is another well-known means for driving the development roller, which is disclosed in Japanese Laid-open Patent Application H11-338211. In the case of this development roller driving means, an Oldham's coupling is used as the member for transmitting driving force to the developing device. The usage of the Oldham's coupling makes it possible to ensure that even if the rotational axis of the driving force output shaft (driving shaft of main assembly) becomes misaligned with the rotational axis of the driving force input shaft (drive shaft of developing device), the development roller driving force is reliably transmitted to the development roller.

In the case of a developing apparatus an electrophotographic image forming apparatus structured so that its developing apparatus is mounted into its main assembly in the direction parallel to the axial line of the development roller, it is also structured so that the developing apparatus receives the development roller driving force through its leading end (downstream end) in terms of the developing apparatus insertion direction, and further, so that the electrical contacts of the developing apparatus, which are for supplying the development roller with development bias, make contact with the counterparts of the main assembly of the image forming apparatus, also at the leading end.

Thus, conventional image forming apparatuses require a large amount of space for routing wiring for the bias contacts.

Further, in a case where an Oldham's coupling is used as the member for the developing apparatus to receive the mechanical force from the main assembly of an image forming apparatus, the thrust generated by the transmission of the driving force is not as large as the thrust generated in a case where a helical gear is used as the member for the developing apparatus to receive the mechanical force from the main assembly of the image forming apparatus. Thus, in the case where an Oldham's coupling is used, it becomes a serious concern how to make the bias contact precisely (reliably) contact, and remain in contact, with the development roller.

SUMMARY OF THE INVENTION

The present invention was made in consideration of the above described concern. Thus, its primary object is to provide a developing apparatus, a process cartridge, and an electrophotographic image forming apparatus, which are characterized in that the electrical contact for the development roller precisely (reliably) contact, and remain in contact, with the development roller.

According to an aspect of the present invention, there is provided a developing apparatus including a developing roller for developing an electrostatic latent image formed on a photosensitive member, wherein said developing apparatus is detachably mountable to a main assembly of an electrophotographic image forming apparatus in an axial direction of said developing roller, said developing apparatus comprising a drive transmission member, provided at one end of said developing roller, for receiving a driving force from the main assembly and transmitting the driving force to said developing roller; an urging member, provided at other end, for urging said developing roller in the axial direction; an abutting portion, provided adjacent said one end, for being abutted by said shaft of said developing roller by an urging force of said urging member to position said developing roller with respect to the axial direction; and a contact member contactable to a main assembly contact provided in the main assembly when said developing apparatus is mounted to the main assembly, wherein said contact member contacts to a peripheral surface of said shaft of said developing roller adjacent said one end to apply a voltage to said developing roller.

According to another aspect of the present invention, there is provided a process cartridge including a photosensitive member, a developing roller for developing an electrostatic latent image formed on said photosensitive member, wherein said process cartridge is detachably mountable to a main assembly of an electrophotographic image forming apparatus in an axial direction of said developing roller, said process cartridge comprising a drive transmission member, provided at one end of said developing roller, for receiving a driving force from the main assembly and transmitting the driving force to said developing roller; an urging member, provided at other end, for urging said developing roller in the axial direction; an abutting portion, provided adjacent said one end, for being abutted by said shaft of said developing roller by an urging force of said urging member to position said developing roller with respect to the axial direction; and a contact member contactable to a main assembly contact provided in the main assembly when said process cartridge is mounted to the main assembly, wherein said contact member contacts to a peripheral surface of said shaft of said developing roller adjacent said one end to apply a voltage to said developing roller.

According to a further aspect of the present invention, there is provided an electrophotographic image forming apparatus for forming an image on a recording material, said apparatus comprising (i) a photosensitive member; (ii) a developing device including a developing roller for developing an electrostatic latent image formed on a photosensitive member, wherein said developing device is mounted to a main assembly of an electrophotographic image forming apparatus in an axial direction of said developing roller, said developing device further including a drive transmission member, provided at one end of said developing roller, for receiving a driving force from the main assembly and transmitting the driving force to said developing roller, an urging member, provided at other end, for urging said developing roller in the axial direction, an abutting portion, provided adjacent said one end, for being abutted by said shaft of said developing roller by an urging force of said urging member to position said developing roller with respect to the axial direction, and a contact member contactable to a main assembly contact provided in the main assembly when said developing apparatus is mounted to the main assembly, wherein said contact member contacts to a peripheral surface of said shaft of said developing roller adjacent said one end to apply a voltage to said developing roller; (iii) mounting means for detachably mounting said developing apparatus; and (iv) feeding means for feeding the recording material.

According to a further aspect of the present invention, there is provided an electrophotographic image forming apparatus for forming an image on a recording material, said apparatus comprising (i) a process cartridge including a photosensitive member, a developing roller for developing an electrostatic latent image formed on said photosensitive member, wherein said process cartridge is mounted to a main assembly of an electrophotographic image forming apparatus in an axial direction of said developing roller, said process cartridge further including a drive transmission member, provided at one end of said developing roller, for receiving a driving force from the main assembly and transmitting the driving force to said developing roller, an urging member, provided at other end, for urging said developing roller in the axial direction, an abutting portion, provided adjacent said one end, for being abutted by said shaft of said developing roller by an urging force of said urging member to position said developing roller with respect to the axial direction, and a contact member contactable to a main assembly contact provided in the main assembly when said process cartridge is mounted to the main assembly, wherein said contact member contacts to a peripheral surface of said shaft of said developing roller adjacent said one end to apply a voltage to said developing roller; (ii) mounting means for detachably mounting said process cartridge; and (iii) feeding means for feeding the recording material.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

In the following descriptions of the preferred embodiments of the present invention, the electrical contacts and driving force transmitting member disclosed in the claim portion of this application will be referred to as development roller contacts and Oldham's coupling, respectively. Further, the surface of the main assembly of the image forming apparatus, upon which the development roller is kept pressed, will be referred as regulating surface.

[Embodiment 1]

Next, the process cartridge (which hereafter will be referred to simply as cartridge) and electrophotographic image forming apparatus (which hereafter will be referred simply as image forming apparatus) in the first preferred embodiment of the present invention will be described with reference to the appended drawings.

(General Structure of Image Forming Apparatus)

Figure 3:
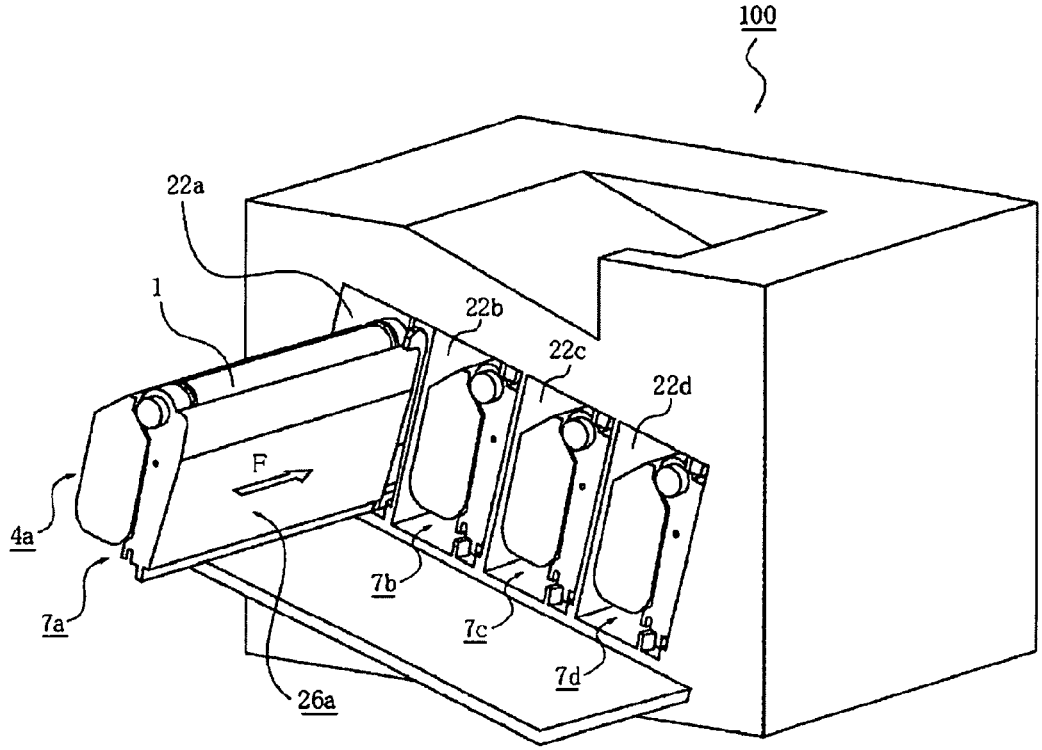
FIG. 3 is a perspective view of the image forming apparatus in FIG. 1 prior to the mounting of the cartridge into the main assembly of the image forming apparatus.

First, referring to FIGS. 1 and 3, the image forming apparatus in this embodiment will be described regarding its general structure. The image forming apparatus 100, shown in FIG. 1, has four cartridge chambers 22 (22*a*-22*d*), where four cartridges are mounted one for one), which are placed in tandem at a preset angle relative to the horizontal direction (FIG. 3). The four cartridges 7 (7*a*-7*d*) in the four cartridge chambers (22*a*-22*d*) are provided with four electrophotographic photosensitive drums 1 (1*a*-1*d*), respectively.

Figure 1:
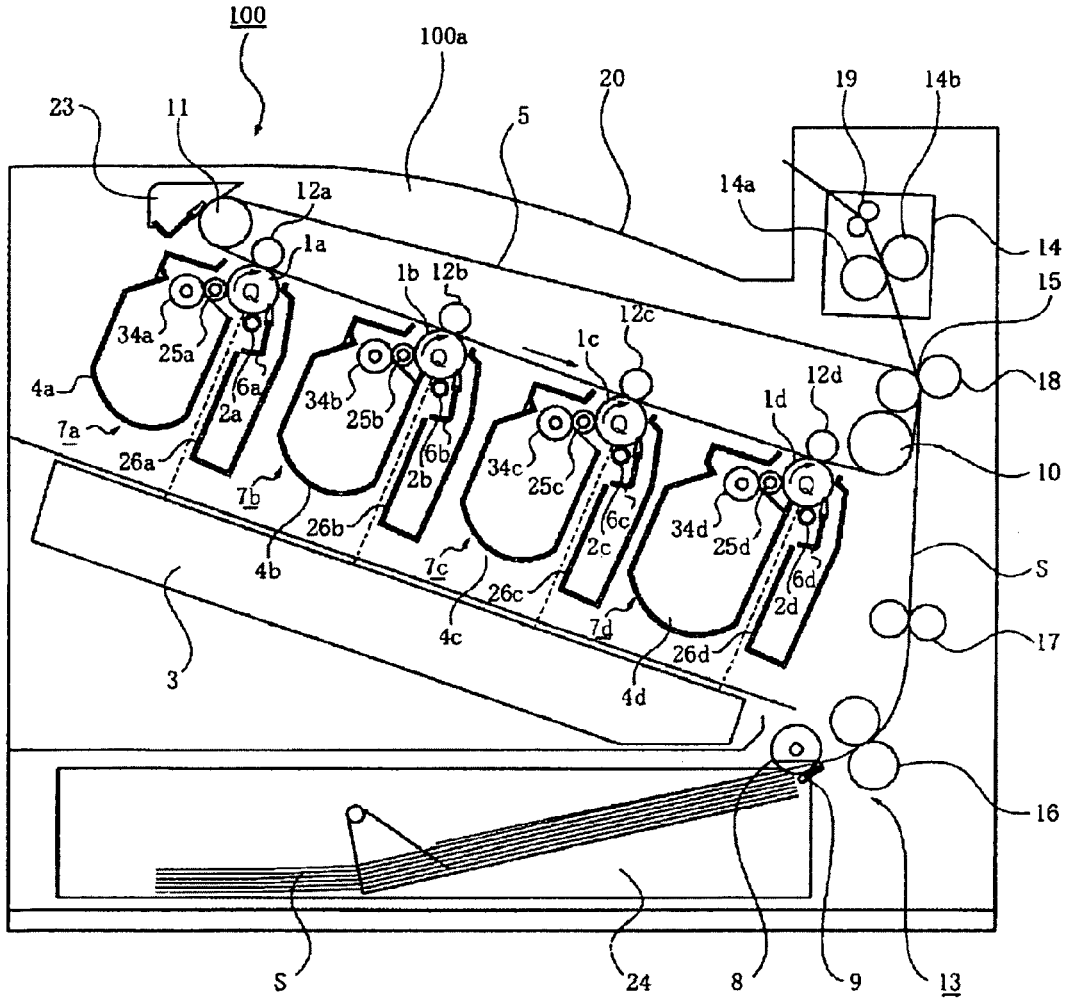
FIG. 1 is a schematic sectional view of the electrophotographic color image forming apparatus in the first preferred embodiment of the present invention, which depicts the general structure of the apparatus.

The electrophotographic photosensitive drum 1 (which hereafter will be referred to simply as photosensitive drum 1) is rotated by a driving member (unshown) in the clockwise direction, shown in FIG. 1. In the adjacencies of the peripheral surface of the photosensitive drum 1, multiple means for processing the photosensitive drum 1 are disposed. More specifically, a cleaning member 6 (6*a*-6*d*), a charge roller 2 (2*a*-2*d*), and a development unit 4 (4*a*-4*d*) are disposed in the listed order. The cleaning member 6 is for removing the developer (which hereafter may be referred to as toner) remaining on the peripheral surface of the photosensitive drum 1 after the abovementioned transfer of the toner image from the photosensitive drum 1. The charge roller 2 is for uniformly charging the photosensitive drum 1 (1*a*-1*d*), respectively, across their peripheral surfaces. The development unit 4 is for developing the abovementioned electrostatic latent image on the photosensitive drum 1 with the use of the toner. As for the main assembly of the image forming apparatus, it is provided with a scanner unit 3 and an intermediary transfer belt 5. The scanner unit 3 forms an electrostatic latent image on the photosensitive drum 1 by projecting a beam of light on the photosensitive drum 1 while modulating the beam with the information regarding the image to be formed. The intermediary transfer belt 5 is the belt onto which four monochromatic toner images, different in color, are sequentially transferred in layers from the four photosensitive drums 1. The photosensitive drum 1, cleaning member 6, charge roller 2, and development unit 4 are integrally disposed in a cartridge 7, which can be removably mountable in the main assembly 100*a* of the image forming apparatus 100 by a user.

The intermediary transfer belt 5 is suspended by a driver roller 10 and a tension roller 11. Further, the main assembly 100*a* of the image forming apparatus 100 (which hereafter will be referred to simply as apparatus main assembly 100*a*) is provided with four primary transfer rollers 12 (12*a*-12*d*), which are disposed in the loop which the intermediary transfer belt 5 forms. To the intermediary transfer belt 5, a transfer bias is applied by a bias applying means (unshown).

After the formation of a toner image on the photosensitive drum 1, the toner image is carried by the photosensitive drum 1 in the direction indicated by an arrow mark Q, while the intermediary transfer belt 5 is circularly rotated in the direction indicated by an arrow mark R, and a positive bias is applied to the primary transfer rollers 12. As a result, the four monochromatic toner images, different in color, are sequentially transferred (primary transfer) in layers onto the intermediary transfer belt 5. Then, the four monochromatic toner images layered on the intermediary transfer belt 5 are conveyed by the intermediary transfer belt 5 to a secondary transfer portion 15 while remaining layered.

Meanwhile, a sheet S of recording medium (which hereafter will be referred to simply as sheet S) is conveyed to the secondary transfer portion 15 by a recording medium feeding apparatus 13, a pair of registration rollers 17, etc., in synchronism with the progression of the above described image forming operation. The recording medium feeding apparatus 13 has: a recording medium feeder cassette 24, in which multiple sheets S of recording medium are stored; a feeder roller 8 for feeding recording mediums into the apparatus main assembly 100*a*; and a pair of conveyer rollers 16 for conveying further the fed sheet S. The feeder cassette 24 can be pulled out of the apparatus main assembly 3 in the frontward direction. The recording sheets S in the feeder cassette 24 are kept pressed against the feeder roller 8 so that the top sheet S is kept pressed on the feeder roller 8. They are fed into the apparatus main assembly 100*a* by a separation pad 9 in such a manner that only the top sheet S is fed into the apparatus main assembly 100*a* while being separated from the other recording mediums S in the feeder cassette 24 (separating system based on friction).

After being fed into the apparatus main assembly 100*a* from the recording medium feeding apparatus 13, each sheet S is conveyed to the secondary transfer portion 15 by the pair of registration rollers 17. In the secondary transfer portion 15, a positive bias is applied to a secondary transfer roller 18. Thus, the four monochromatic toner images, different in color, on the intermediary transfer belt 5 are transferred together (secondary transfer) onto the sheet S while the four toner images and the sheet S are conveyed through the secondary transfer portion 15.

A fixing portion 14, which is a fixing means, is a portion for fixing an unfixed color toner image on the sheet S, to the sheet S by applying heat and pressure to the sheet S and the unfixed toner image thereon after the transfer of the color toner image onto the sheet S. The fixation belt 14*a* is cylindrical, and is guided by a belt guiding member (unshown) having heating means, such as a heater, bonded to the belt guiding member. The fixation belt 14*a* and a pressure roller 14*b* are kept pressed upon each other by a preset amount of pressure to form a fixation nip between the belt 14*a* and roller 14*b*.

After the formation of an unfixed toner image on the sheet S in the image forming portion, the sheet S is conveyed from the image forming portion to the fixing portion 14, and then, is conveyed through the fixation nip, which is the interface between the fixation belt 14*a* and pressure roller 14*b*. While the sheet S is conveyed through the fixation nip, the sheet S and the multicolor toner images thereon are subjected to heat and pressure. As a result, the unfixed multicolor toner image becomes fixed to the sheet S. Thereafter, the sheet S, that is, the sheet to which the multicolor toner images has just been fixed, is discharged into a delivery tray 20 by a pair of discharge rollers 19.

Meanwhile, the toner remaining on the peripheral surface of each of the photosensitive drums 1 after the primary transfer of the toner image, is removed by the cleaning member 6. The removed toner is recovered into a toner chamber with which the latent image formation units 26 (26*a*-26*d*) are provided.

The toner remaining on the intermediary transfer belt 5 after the transfer (secondary transfer) of the multicolor toner image onto the sheet S is removed by a transfer belt cleaning apparatus 23. The removed toner is recovered into a waste toner recovery container disposed in the rear end portion of the apparatus main assembly 100*a*.

(Cartridge)

Figure 2:
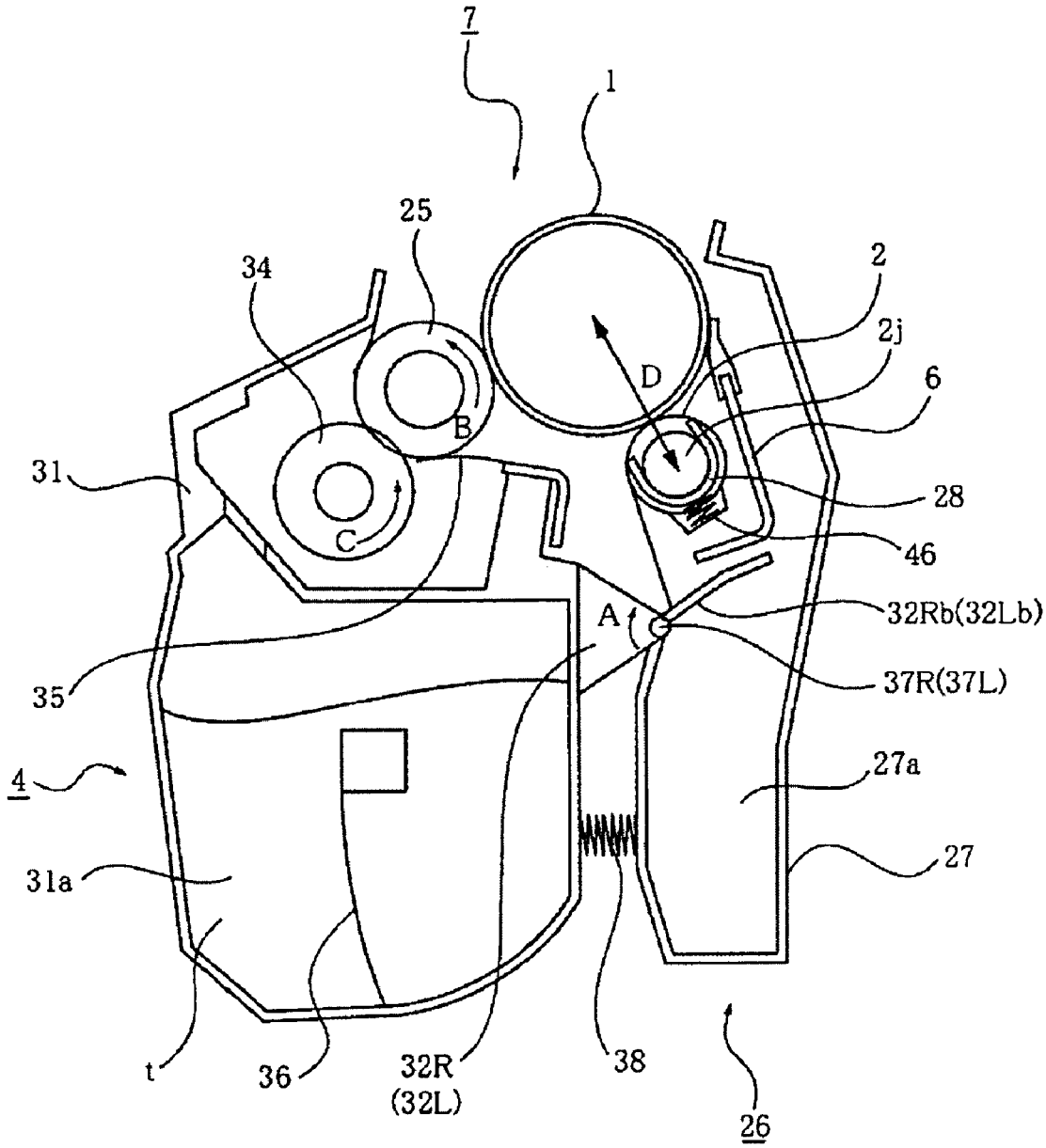
FIG. 2 is a schematic sectional view of the cartridge for the image forming apparatus shown in FIG. 1.

Next, referring to FIG. 2, the cartridge in this embodiment will be described. FIG. 2 is a schematic section view of the cartridge 7, which contains toner t, at a plane perpendicular to the lengthwise direction of the cartridge 7. Incidentally, the cartridge for storing yellow toner t is referred to as cartridge 7*a*, and the cartridge for storing magenta toner t is referred to as cartridge 7*b*. Further, the cartridge for storing cyan toner t is referred to as cartridge 7*c*, and the cartridge for storing black toner t is referred to as cartridge 7*d*. The four cartridges 7*a*-7*d* are the same in structure.

Each cartridge 7 is made up of a latent image formation unit 26 and a development unit 4. The latent image formation unit 26 is provided with the photosensitive drum 1, charge roller 2 (charging means), and cleaning member 6 (cleaning means). The development unit 4 has the development roller 25 (developing means).

The photosensitive drum 1 is rotatably attached to the cleaning means frame portion 27 of the latent image formation unit 26, with the bearings (which will be described later) disposed between the cleaning means frame portion 27 and the photosensitive drum 1. During an image forming operation, the photosensitive drum 1 is rotated by transmitting driving force to the photosensitive drum 1 from a motor (unshown) for driving the latent image formation unit 26. There are the charge roller 2 and cleaning member 6 in the adjacencies of the peripheral surface of each photosensitive drum 1 as described above. As the transfer residual toner, more specifically, the toner remaining on the peripheral surface of the photosensitive drum 1 is removed by the cleaning member 6, it falls into the removed toner storage chamber 27*a*. A pair of charge roller bearings 28 are attached to the cleaning means frame portion 27 in such a manner that they can be moved in the direction indicated by an arrow mark D which coincides with the axial line of the photosensitive drum 1 and the axial line of the charge roller 2. The shaft 2*j* (rotational axle) of the charge roller 2 is rotatably supported by the pair of charge roller bearings 28. Further, the charge roller bearings 28 are kept pressed toward the photosensitive drum 1 by a pair of charge roller pressing members 46.

The development unit 4 has a development roller 25 and a development unit frame 31. The development roller 25 rotates in contact with the photosensitive drum 1 in the direction indicated by an arrow mark B. The development roller 25 is rotatably supported by the development unit frame 31 with a pair of bearings 32 (32R and 32L) disposed between the lengthwise end portions (in terms of direction parallel to axial line of development roller 25) and the right and left walls of the development unit frame 31, respectively. Further, the development unit 4 is provided with a toner supply roller 34 and a development blade 35, which are disposed in the adjacencies the peripheral surface of the development roller 25. The toner supply roller 34 rotates in contact with the development roller 25 in the direction indicated by an arrow mark C. The development blade 35 is for regulating in thickness the layer of toner on the peripheral surface of the development roller 25. Further, the development unit 4 is provided with a toner conveying member 36 for conveying the toner in the development unit 4 to the abovementioned toner supply roller 34 while stirring the toner. The toner conveying member 36 is disposed in the toner storage portion 31*a* of the development unit frame 31.

The development unit 4 is connected to the latent image formation unit 26 with the use of a pair of shafts 37 (37R and 37L) put through the holes 32R and 32L with which the bearings 32R and 32L are provided, respectively, in such a manner that the two units 4 and 26 are enabled to rotationally move relative to each other about the pair of shafts 37. The development unit 4 is kept under the pressure by a pair of compression springs 38. Thus, as the cartridge 7 is mounted into the apparatus main assembly 100*a*, the development unit 4 rotates about the pair of shafts 37 in the direction indicted by an arrow mark A, causing the development roller 25 to come into contact with the photosensitive drum 1, and ensures that the development roller 25 remains in contact with the photosensitive drum 1 during image formation.

(Structure of Oldham's Coupling)

Figure 13:
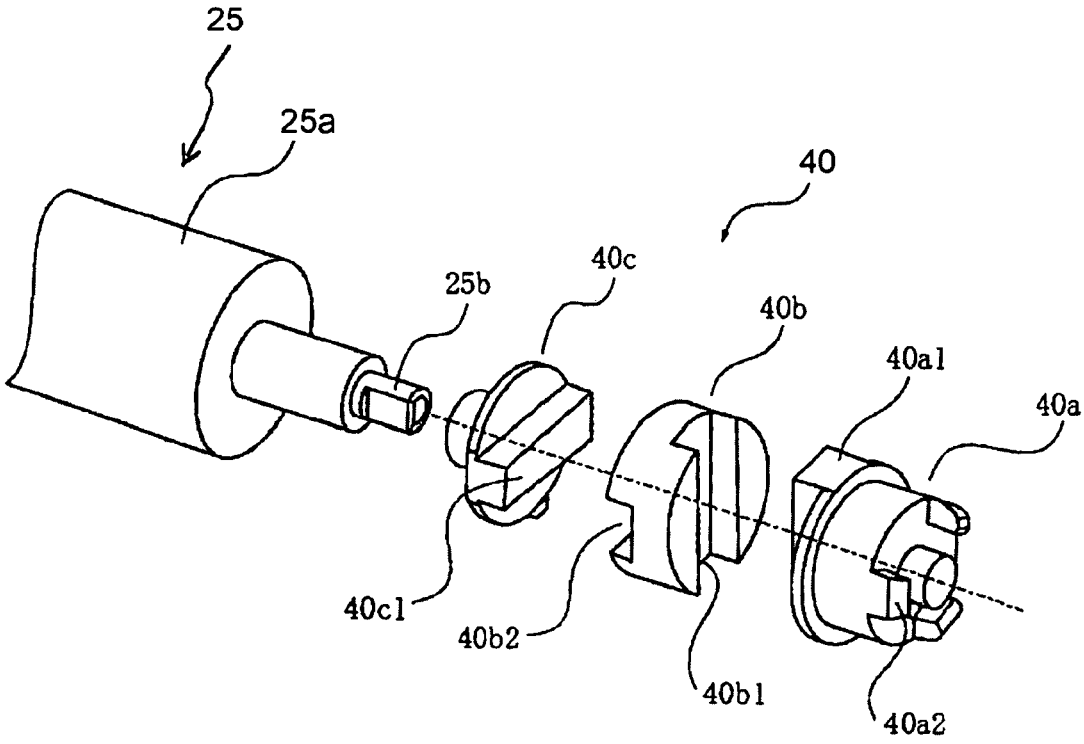
FIG. 13 is an exploded perspective view of the Oldham's coupling, which is for describing the structure of the coupling.

Next, referring to FIG. 13, the driving force transmitting member (which hereafter may be referred to as Oldham's coupling) in this embodiment will be described. FIG. 13 is a perspective and exploded view of the Oldham's coupling. The Oldham's coupling 40 is attached to one of the lengthwise ends of the shaft 25*b* of the development roller 25 in terms of the direction parallel to the axial line of the development roller 25. The Oldham's coupling 40 is made up of a driving force receiving portion 40*a*, a center portion 40*b*, and a driving force transmitting portion 40*c*. The engaging portion 40*a*2 of the driving force receiving portion 40*a* receives the development roller driving force from the apparatus main assembly 100*a* by engaging with a coupling 100*b* (FIG. 6) of the apparatus main assembly 100*a*, which is connected to the drive shaft of the apparatus main assembly 100*a*. Incidentally, the development roller shaft 25*b* is rotatably supported by the bearing 32R (FIG. 6(*b*)), which is solidly fixed to the development unit frame (unshown).

The driving force transmitting portion 40*c* is solidly fixed to the development roller shaft 25*b* in such a manner that their axes coincide. The driving force transmitting portion 40*c* has a rib 40*c*1, which is an integrally formed part of the driving force transmitting portion 40*c*. The driving force receiving portion 40*a* has three engaging portions 40*a*2 and a rib 40*a*1, which are integrally formed parts of the driving force receiving portion 40*a*. The center portion 40*b* has a groove 40*b*2 into which the rib 40*c*1 of the driving force transmitting portion 40*c* fits. It has also a groove 40*b*1 into which the rib 40*a*1 of the driving force receiving portion 40*a* fits.

(Structural Arrangement for Keeping Development Roller Contact in Contact with Development Roller Shaft)

Next, referring to FIGS. 4, 5, 6, 8, 10, 11, and 13, the relationship between the electrical contact for the development roller 25, and the development roller shaft, will be described.

Figure 4:
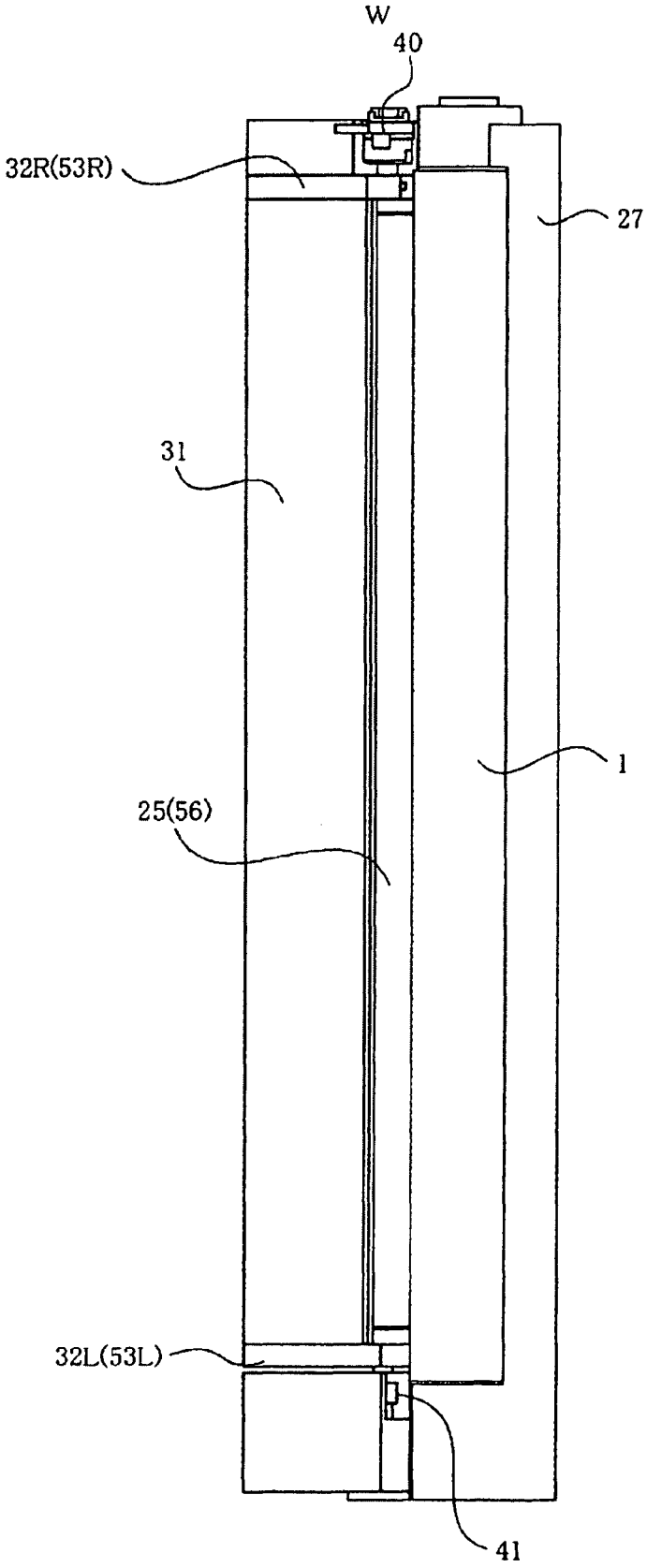
FIG. 4 is a top plan view of the cartridge, which shows the general structure of the cartridge.
Figure 5:
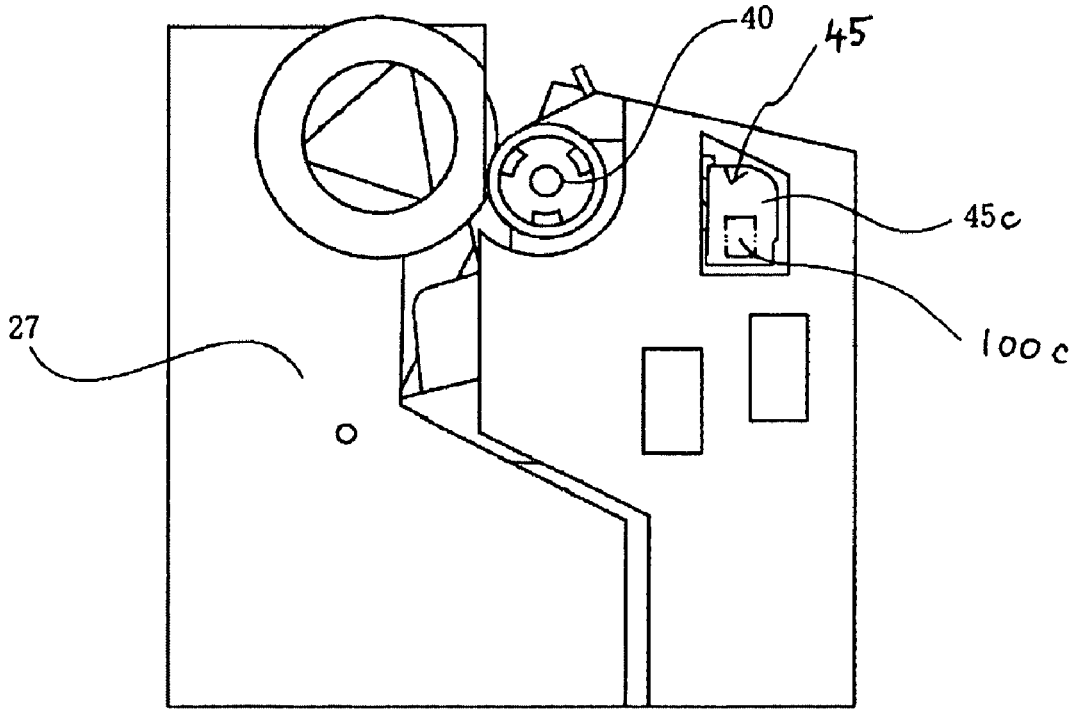
FIG. 5 is a side view of the cartridge, as seen from the leading side of the cartridge in terms of the direction in which the cartridge is mounted into the main assembly of the image forming apparatus, which also depicts the structure of the cartridge.
Figure 6A:
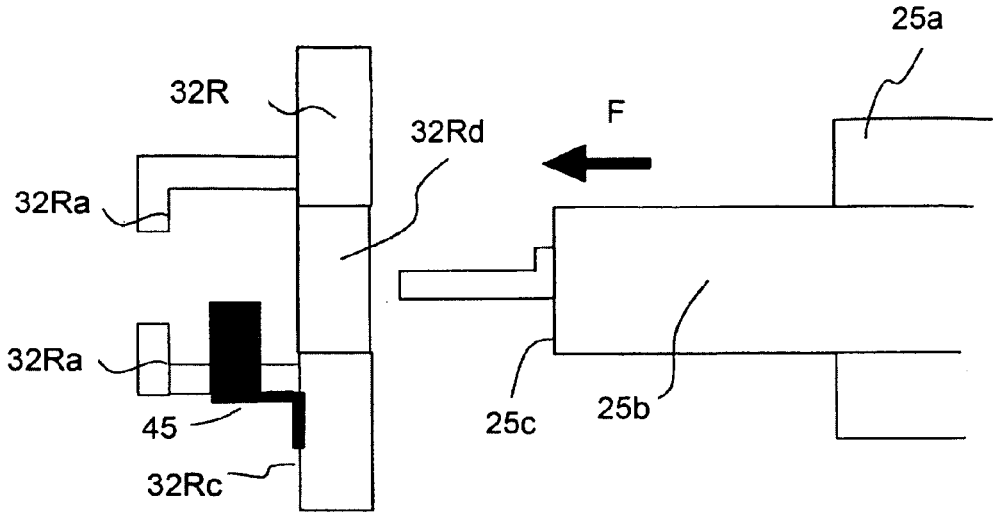
FIGS. 6(*a*) and 6(*b*) are schematic sectional views of the lengthwise end portion of the development roller, from which the development roller is driven.
Figure 6B:
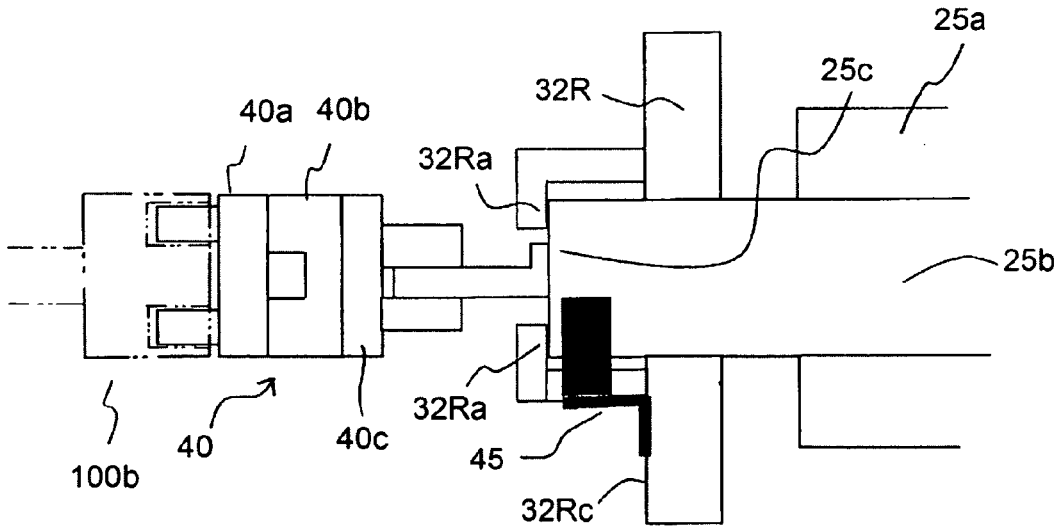
Figure 8:
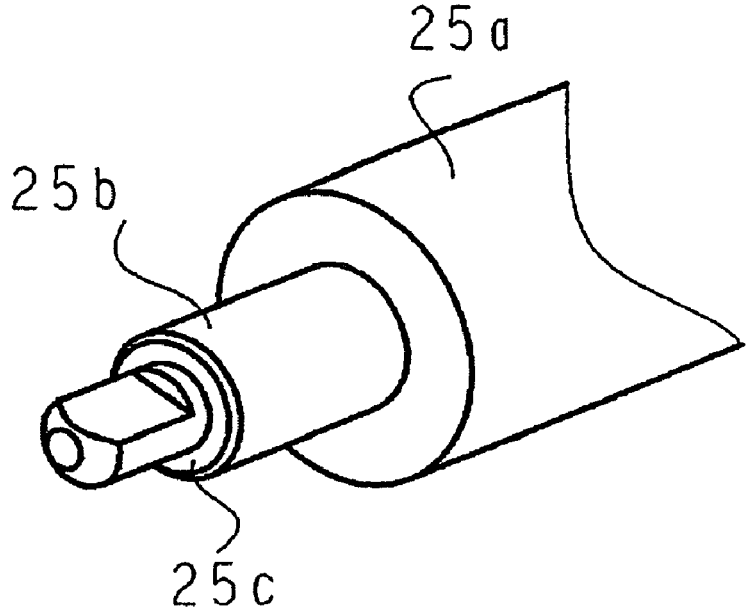
FIG. 8 is a perspective view of the lengthwise end portion of the development roller, in the first preferred embodiment, by which the development roller is driven.
Figure 10:
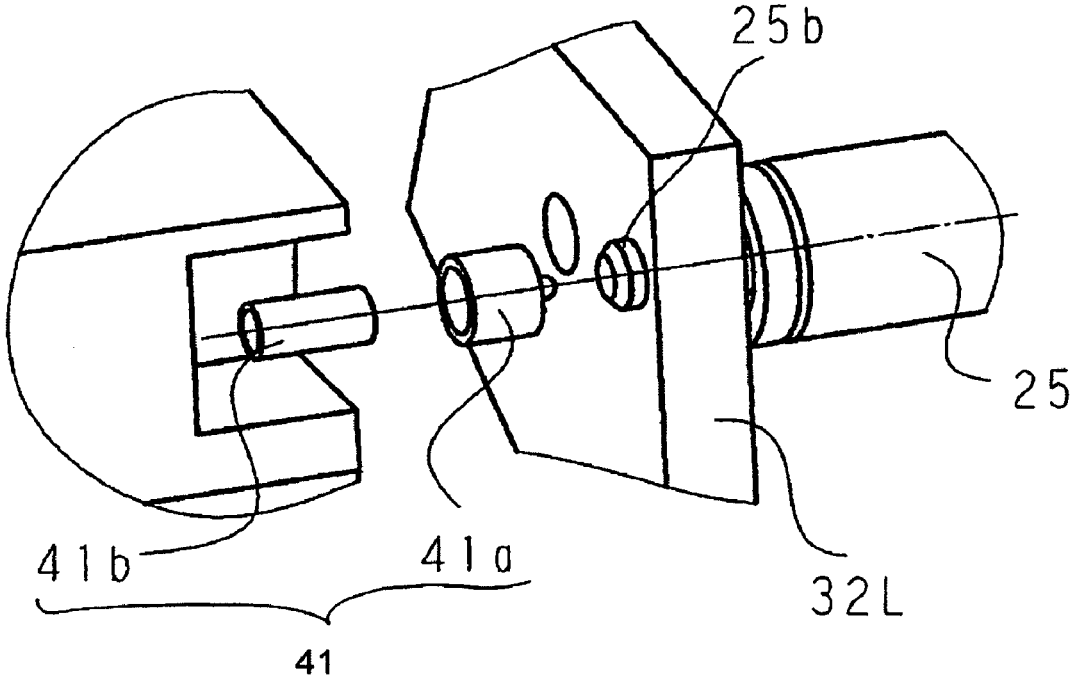
FIG. 10 is a schematic, perspective, and exploded view of one of the lengthwise end portion of the development roller pressing member, and its adjacencies, from which the developing apparatus is not driven, which is for describing the structure of the pressing member.
Figure 11:
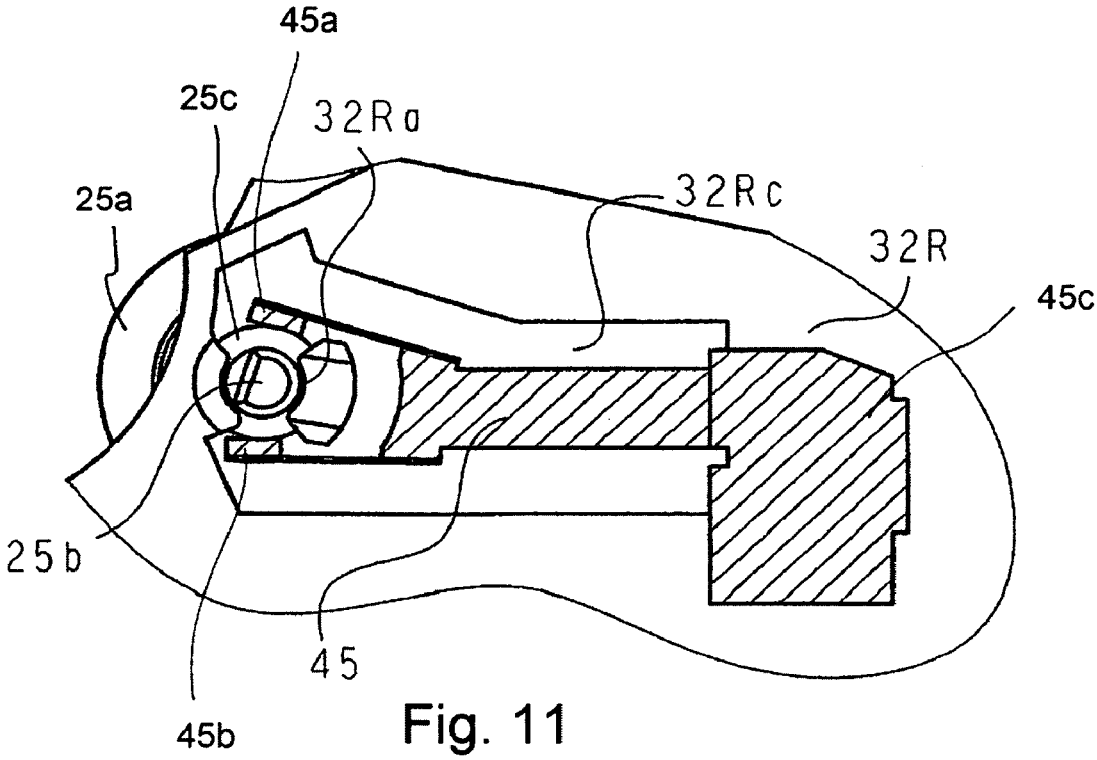
FIG. 11 is a side view of the development unit in the first preferred embodiment, as seen from the deepest end of the apparatus main assembly in terms of the cartridge insertion direction, with the Oldham's coupling 40 removed.

FIG. 4 is a top view of the cartridge 7. A referential letter W in FIG. 4 indicates the side from which the cartridge 7 is driven, in terms of the lengthwise direction of the cartridge 7. FIG. 5 is a side view of the cartridge 7 as seen from the cartridge driving side W. FIG. 6 is a combination of enlarged sectional views of the lengthwise end portions of the development unit 4, from which the development unit 4 is driven. More specifically, FIGS. 6(*a*) and 6(*b*) are enlarged sectional views of the lengthwise end portion of the development unit 4 prior to and after, respectively, the attachment of the development roller 25 to the development unit frame. Designated by a referential number 45 is the electrical contact (which hereafter will be referred to simply as development roller contact), which is on the reader's side of the plane of FIG. 6. FIG. 8 is a perspective view of the lengthwise end portion of the development roller shaft 25*b*, which is on the side from which the development roller 25 is driven. FIG. 10 is a perspective exploded view of the a pressure applying member 41, which is at the lengthwise end of the development roller shaft 25*b*, from which development roller 25 is not driven. FIG. 8 shows the structure of the pressure applying member 41. FIG. 11 is a side view of the development unit 4, as seen from the driving side W (FIG. 10), with the Oldham's coupling 40 removed.

Referring to FIGS. 4 and 6, the Oldham's coupling 40 (male coupling) is attached to the lengthwise end of the development roller shaft 25*b*, on the side from which the development roller 25 is driven. As the cartridge 7 is mounted into the apparatus main assembly 100*a* of the image forming apparatus 100, the driving force receiving portion 40*a* of the Oldham's coupling 40 engages with the coupling (female coupling) 100*b* (FIG. 6(*b*)), which is the driving force transmitting member of the apparatus main assembly 100*a*, making it possible for the development roller driving force to be transmitted from the apparatus main assembly 100*a* to the development roller 25. Next, referring to FIG. 5, also as the cartridge 7 is mounted into the apparatus main assembly 100*a*, the contact point 45*c* of the development roller contact 45 comes into contact with the electrical contact 100*c* with which the apparatus main assembly 100*a* is provided, making it possible for the bias voltage to be applied to the development roller 25 from the apparatus main assembly 100*a* through the development roller contact 45.

Further, the development unit 4 is provided with the pressure applying member 41, which is at the opposite lengthwise end of development unit 4 from the lengthwise end from which the development unit 4 is driven. Referring to FIG. 10, the pressure applying member 41 is made up of a nonelastic member 41*a* and an elastic member 41*b*. The elastic member 41*b* applies pressure to the development roller shaft 25*b* through the nonelastic member 41*a*, keeping thereby the development roller 25 pressured toward the driving side W.

Next, referring to FIG. 8, the lengthwise end portion of the development roller shaft 25*b*, which is on the driving side W, is reduced in diameter relative to the rest of the development roller shaft 25*b*, providing thereby the development roller shaft 25*b* with a pressure taking surface 25*c*. Next, referring to FIG. 6(*a*), the bearing 32R is provided with a roller shaft accommodating hole 32Rd and a development roller shaft catching surface 32Ra (which hereafter may be referred to as regulating surface 32Ra). More specifically, the bearing 32R is provided with a pair of development roller shaft catching portions, which extend from the main portion of the bearing 32R toward the Oldham's coupling 40. That is, the development roller shaft catching surface 32Ra is the surface of the development roller shaft catching portion, which faces toward the development roller 25. Further, the abovementioned development roller contact 45, which is for applying the bias voltage to the development roller 25, is attached to the electrical contact placement surface 32Rc of the bearing 32R. During the assembly of the development unit 4, the shaft 25*b* of the development roller 25 is inserted into the bearing 32R in the direction indicated by an arrow mark F in FIG. 6(*a*). Next, referring to FIG. 6(*b*), the development roller 25 is kept pressured toward the driving side W by the pressure applying member 41 (FIG. 10), which is located at the lengthwise end of the development roller 25, from which the development roller 25 is not driven. Thus, the pressure taking surface 25*c* of the development roller shaft 25*b* is kept in contact with the regulating surface 32Ra of the bearing 32R; in other words, the development roller 25 is kept precisely positioned in terms of its lengthwise direction. Further, the development roller contact 45 is kept in contact with the development roller shaft 25*b*, between the regulating surface 32Ra and contact placement surface 32Rc. More specifically, referring to FIG. 11, the development roller contact 45 contacts the peripheral surface of the development roller shaft 25*b* by its contact points 45*a* and 45*b*.

Even in a case where the combination of the Oldham's coupling 40 and pressure applying member 41 is used as it is in this embodiment, the space necessary for connecting the cartridge 7 to the apparatus main assembly 100*a* in mechanical and electrical terms can be significantly reduced (smallest possible without sacrificing function) by structuring an image forming apparatus so that the development roller contact 45 contacts the peripheral surface of the development roller shaft 25*b* on the side from which the development roller 25 is driven, instead of structuring an image forming apparatus so that the development roller contact 45 contacts the lengthwise end surface of the development roller shaft 25*b* on the side from which the development roller 25 is not driven. Further, because the development roller 25 is kept pressured toward the driven side W, the position of the contact between the development roller contact 45 and development roller shaft 25*b* is significantly closer to the referential point of contact between the cartridge 7 and apparatus main assembly 100*a*, compared to the position of the contact between the development roller contact (45) and development roller shaft (25*b*) in a conventional image forming apparatus. Therefore, this structural design makes the image forming apparatus 100, more specifically, the cartridge 7 and apparatus main assembly 100*a*, less likely to be adversely affected by the tolerance of the components of the cartridge 7 and apparatus main assembly 100*a*, making it possible to reduce in size the spaces to be provided in anticipation of the effects (rattling or the like) attributable to the tolerance. Thus, the structural design of the image forming apparatus in this embodiment can reduce in size the cartridge 7 by reducing in length the cartridge 7. Further, the cartridge 7 and apparatus main assembly

100*a* in this embodiment are structured so that the development roller contact 45 and pressure taking surface 25*c* are positioned on the outward side of the hole 32Rd of the bearing 32R. Therefore, the portion of the development roller shaft 25*a*, which is on the inward side of the bearing 32R, and the portion of the development roller shaft 25*b*, which fits in the hole 32Rd of the bearing 32R, can be formed continuous and the same in diameter. Therefore, it is unnecessary to take into consideration the geometrical tolerance regarding coaxially or the like, unlike the case where the portion of the development roller shaft 25*b*, which is on the inward side of the bearing 32R and the portion of the development roller shaft 25*b*, which is on the outward side of the bearing 32R, are different in diameter. Thus, the structural design for the image forming apparatus in this embodiment can reduces in amount the tolerance of the components of an image forming apparatus. Further, the portions by which the development roller 25 is supported, and the elastic portion 25*a* of the development roller 25, which contacts the photosensitive drum 1, are coaxial. Therefore, the development roller 25 is stable in rotation, ensuring that the image forming apparatus 100 remains stable in image quality.

[Embodiment 2]

(Structural Arrangement for Keeping Development Roller Contact in Contact with Development Roller Shaft)

Next, referring to FIGS. 4, 5, 7, 9, 10, 12, and 13, the relationship between the development roller contact and development roller shaft in the second preferred embodiment of the present invention will be described.

Figure 7A:
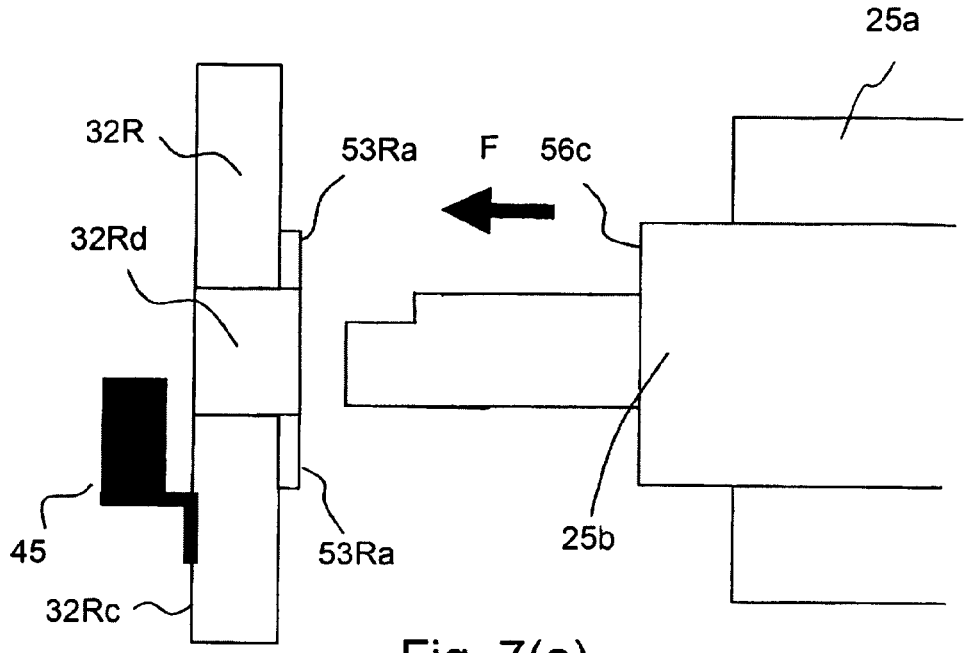
FIGS. 7(*a*) and 7(*b*) are sectional views of the lengthwise end portion of the development roller, in another embodiment of the present invention, from which the development roller is driven.
Figure 7B:
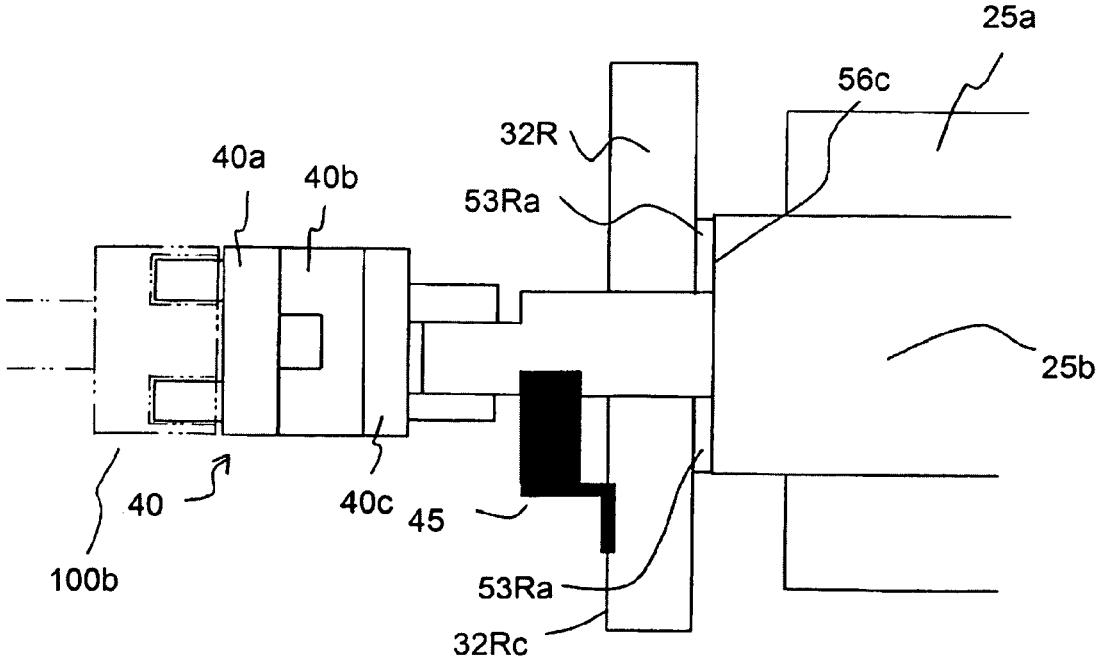
Figure 9:
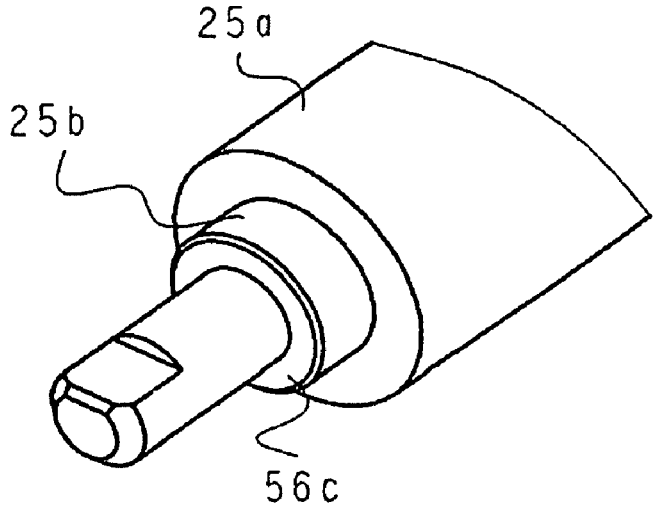
FIG. 9 is a perspective view of the lengthwise end portion of the development roller, in another preferred embodiment, from which the development roller is driven.
Figure 12:
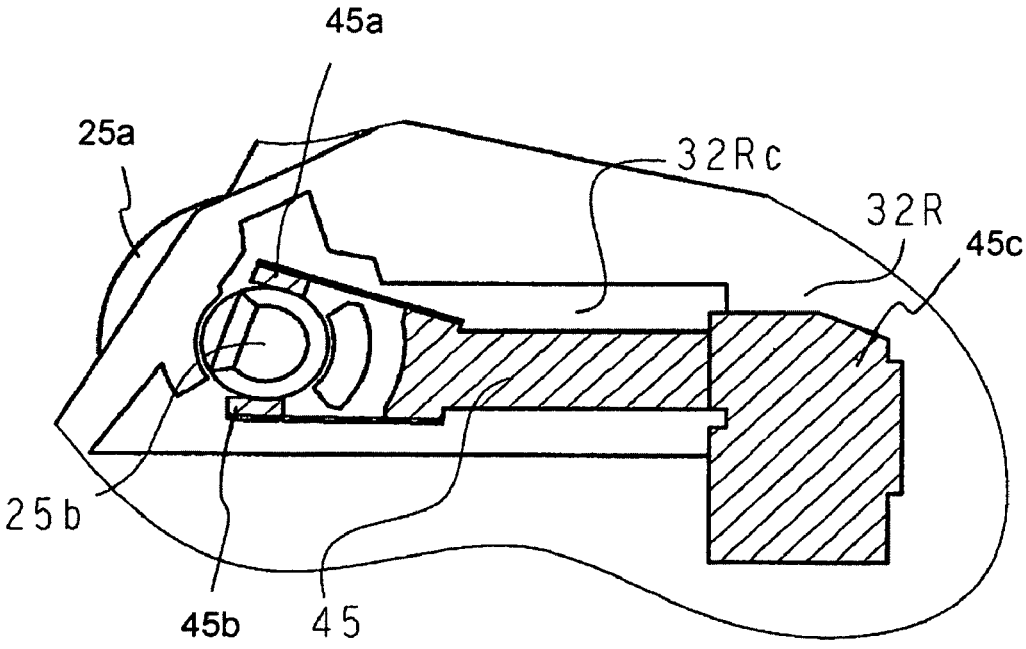
FIG. 12 is a side view of the development unit 4 in another embodiment, as seen from the deepest end of the apparatus main assembly in terms of the cartridge insertion direction, with the Oldham's coupling 40 removed.

FIG. 4 is a top plan view of the cartridge 7. A letter W in FIG. 4 indicates the side from which the cartridge 7 is driven. FIG. 5 is a side view of the cartridge 7 as seen from the driving side W. FIG. 7 is a combination of enlarged sectional views of the lengthwise end of the development unit 4, from which the development unit 4 is driven, and the bearing 32R, in the second embodiment of the present invention. More specifically, FIGS. 7(*a*) and 7(*b*) are enlarged sectional views of the lengthwise end portion of the development unit 4, from which the development unit 4 is driven, prior to and after, respectively, the attachment of the development roller 25 to the frame (bearing) of the development unit. Designated by a referential number 45 in FIG. 7 is the development roller contact, which is on the reader's side of the plane of FIG. 7. FIG. 9 is a perspective view of the lengthwise end portion of the development roller shaft 25*b*, from which the development roller 25 is driven. FIG. 10 is a perspective view of the a pressure applying member 41, which is at the lengthwise end of the development roller shaft 25*b*, from which development roller 25 is not driven, and shows the structure of the pressure applying member 41. FIG. 12 is a side view of the development unit 4, as seen from the driving side W (FIG. 10), that is, the side from which the development roller 25 is driven, with the Oldham's coupling 40 removed.

Referring to FIGS. 4 and 7, the Oldham's coupling 40 (male coupling) is attached to the lengthwise end of the development roller shaft 25*b*, on the side from which the development roller 25 is driven. As the cartridge 7 is mounted into the apparatus main assembly 100*a* of the image forming apparatus 100, the driving force receiving portion 40*a* of the Oldham's coupling 40 engages with the coupling 100*b* (FIG. 7(*b*)), which is the driving force transmitting member of the apparatus main assembly 100*a*, making it possible for the development roller driving force to be transmitted from the apparatus main assembly 100*a* to the development roller shaft 25*b*.

Further, the development unit 4 is provided with the pressure applying member 41, which is at the opposite lengthwise end of development unit 4 from the lengthwise end from which the development unit 4 is driven. Referring to FIG. 10, the pressure applying member 41 is made up of a nonelastic member 41*a* and an elastic member 41*b*. The elastic member 41*b* applies pressure to the development roller shaft 25*b* through the nonelastic member 41*a*, keeping thereby the development roller 25 pressured toward the driving side W.

Next, referring to FIG. 9, the lengthwise end portion of the development roller shaft 25*b* on the driving side W is reduced in diameter relative to the rest of the development roller shaft 25*b*, providing thereby the development roller shaft 25*b* with a pressure taking surface 56*c*. Next, referring to FIG. 7(*a*), the bearing 32R is provided with a roller shaft accommodating hole 32Rd and a regulating surface 53Ra. More specifically, the bearing 32R is provided with a pair of development roller shaft catching portions, which slightly protrude from the main portion of the bearing 32R toward the direction from which the development roller shaft 25*d* is inserted into the bearing 32R. The regulating surface 53Ra is the surface of the development roller shaft catching portion, which faces toward the development roller 25. Further, the abovementioned development roller contact 45 is attached to the electrical contact placement surface 32Rc of the bearing 32R. During the assembly of the development unit 4, the shaft 25*b* of the development roller 25 is inserted into the bearing 32R in the direction indicated by an arrow mark F in FIG. 7(*a*). Next, referring to FIG. 7(*b*), the development roller 25 is kept pressured toward the driving side W by the pressure applying member 41 (FIG. 10), which is located at the lengthwise end of the development roller 25, from which the development roller 25 is not driven. Thus, the pressure taking surface 56*c* of the development roller shaft 25*b* is kept in contact with the regulating surface 53Ra of the bearing 32R; in other words, the development roller 25 is kept precisely positioned in terms of its lengthwise direction. Further, the development roller contact 45 is kept in contact with the development roller shaft 25*b*, between the Oldham's coupling 40 and contact placement surface 32Rc. That is, the development roller contact 45 contacts the peripheral surface of the development roller shaft 25*b* by its contact points 45*a* and 45*b* as shown in FIG. 12.

Even in a case where the combination of the Oldham's coupling 40 and pressure applying member 41 is used as it is in this embodiment, the space necessary for connecting the cartridge 7 to the apparatus main assembly 100*a* in mechanical and electrical terms can be significantly reduced (smallest possible without sacrificing function) by structuring an image forming apparatus so that the development roller contact 45 contacts the peripheral surface of the development roller shaft 25*b*, on the side from which the development roller 25 is driven, instead of structuring an image forming apparatus so that the development roller contact 45 contacts the lengthwise end surface of the development roller shaft 25*b*, on the side from which the development roller 25 is not driven. Further, because the development roller 25 is kept pressured toward the driven side W, with the use of the pressure applying member 41, the position of the contact between the development roller contact 45 and development roller shaft 25*b* is significantly closer to the referential point of contact between the cartridge 7 and apparatus main assembly 100*a*, compared to the position of the contact between the development roller contact (45) and development roller shaft (25*b*) in a conventional image forming apparatus. Therefore, this structural design makes the image forming apparatus 100, more specifically, the cartridge 7 and apparatus main assembly 100*a*, less likely to be adversely affected by the tolerance of the components of the cartridge 7 and apparatus main assembly

100*a*, making it possible to reduce in size the spaces to be provided in anticipation of the effects (rattling or the like) attributable to the tolerance. Thus, the structural design of the image forming apparatus in this embodiment can reduce in size the cartridge 7 by reducing in length the cartridge 7. Further, the cartridge 7 and apparatus main assembly 100*a* are structured so that the development roller contact 45 and pressure taking surface 25*c* are positioned at the hole 32Rd of the bearing 32R (more specifically, on the upstream side as seen from side from which development roller shaft 25*b* is inserted into bearing 32R). Therefore, it is possible to utilize a conventional bearing (32) without modifying it in shape and/or providing it with the space for mechanical and electrical connection. In other words, the present invention can reduce in size an image forming apparatus by simplifying in structure the bearings for supporting the development roller shaft.

As described above, according to the present invention, both the member for transmitting mechanical driving force to the development roller, and the electrical contact for transmitting electrical power to the development roller, are positioned at one of the lengthwise ends of the development roller shaft (same lengthwise end), and therefore, it is unnecessary for the space for the electrical contact to be provided at the other lengthwise end. In other words, the present invention can reduce in size a developing apparatus and a process cartridge. Further, according to the present invention, a development roller is kept under pressure so that one of its lengthwise ends remains in contact with the surface of the corresponding development roller bearing. Therefore, it is ensured that the electrical contact for the development roller remains precisely positioned relative to the development roller shaft.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 138040/2008 and 107877/2009 filed May 27, 2008 and Apr. 27, 2009, respectively which are hereby incorporated by reference.

What is claimed is:

1. A developing apparatus including a developing roller for developing an electrostatic latent image formed on a photosensitive member, wherein said developing apparatus is detachably mountable to a main assembly of an electrophotographic image forming apparatus in an axial direction of said developing roller, said developing apparatus comprising:

a drive transmission member, provided at one end of said developing roller, for receiving a driving force from the main assembly and transmitting the driving force to said developing roller;

an urging member, provided at other end, for urging said developing roller in the axial direction;

an abutting portion, provided adjacent said one end, for being abutted by said shaft of said developing roller by an urging force of said urging member to position said developing roller with respect to the axial direction; and a contact member contactable to a main assembly contact provided in the main assembly when said developing apparatus is mounted to the main assembly, wherein said contact member contacts to a peripheral surface of said shaft of said developing roller adjacent said one end to apply a voltage to said developing roller.

2. An apparatus according to claim 1, wherein said drive transmission member includes an Oldham coupling.

3. An apparatus according to claim 1, wherein said abutting portion is disposed outside a contact position where said contact member contacts to said shaft with respect to the axial direction.

4. An apparatus according to claim 1, wherein said abutting portion is disposed inside a contact position where said contact member contacts to said shaft with respect to the axial direction.

5. A process cartridge including a photosensitive member, a developing roller for developing an electrostatic latent image formed on said photosensitive member, wherein said process cartridge is detachably mountable to a main assembly of an electrophotographic image forming apparatus in an axial direction of said developing roller, said process cartridge comprising:

a drive transmission member, provided at one end of said developing roller, for receiving a driving force from the main assembly and transmitting the driving force to said developing roller;

an urging member, provided at other end, for urging said developing roller in the axial direction;

an abutting portion, provided adjacent said one end, for being abutted by said shaft of said developing roller by an urging force of said urging member to position said developing roller with respect to the axial direction; and a contact member contactable to a main assembly contact provided in the main assembly when said process cartridge is mounted to the main assembly, wherein said contact member contacts to a peripheral surface of said shaft of said developing roller adjacent said one end to apply a voltage to said developing roller.

6. A process cartridge according to claim 5, wherein said drive transmission member includes an Oldham coupling.

7. A process cartridge according to claim 5, wherein said abutting portion is disposed inside a contact position where said contact member contacts to said shaft with respect to the axial direction.

8. A process cartridge according to claim 5, wherein said abutting portion is disposed outside a contact position where said contact member contacts to said shaft with respect to the axial direction.

9. An electrophotographic image forming apparatus for forming an image on a recording material, said apparatus comprising:

(i) a photosensitive member;

(ii) a developing device including a developing roller for developing an electrostatic latent image formed on a photosensitive member, wherein said developing device is mounted to a main assembly of an electrophotographic image forming apparatus in an axial direction of said developing roller, said developing device further including, a drive transmission member, provided at one end of said developing roller, for receiving a driving force from the main assembly and transmitting the driving force to said developing roller, an urging member, provided at other end, for urging said developing roller in the axial direction, an abutting portion, provided adjacent said one end, for being abutted by said shaft of said developing roller by an urging force of said urging member to position said developing roller with respect to the axial direction, and a contact member contactable to a main assembly contact provided in the main assembly when said developing apparatus is mounted to the main assembly, wherein said contact member contacts to a peripheral surface of said shaft of said developing roller adjacent said one end to apply a voltage to said developing roller;

(iii) mounting means for detachably mounting said developing apparatus; and (iv) feeding means for feeding the recording material.

10. An electrophotographic image forming apparatus for forming an image on a recording material, said apparatus comprising:

(i) a process cartridge including a photosensitive member, a developing roller for developing an electrostatic latent image formed on said photosensitive member, wherein said process cartridge is mounted to a main assembly of an electrophotographic image forming apparatus in an axial direction of said developing roller, said process cartridge further including, a drive transmission member, provided at one end of said developing roller, for receiving a driving force from the main assembly and transmitting the driving force to said developing roller, an urging member, provided at other end, for urging said developing roller in the axial direction, an abutting portion, provided adjacent said one end, for being abutted by said shaft of said developing roller by an urging force of said urging member to position said developing roller with respect to the axial direction, and a contact member contactable to a main assembly contact provided in the main assembly when said process cartridge is mounted to the main assembly, wherein said contact member contacts to a peripheral surface of said shaft of said developing roller adjacent said one end to apply a voltage to said developing roller;

(ii) mounting means for detachably mounting said process cartridge; and (iii) feeding means for feeding the recording material.

* * * * *